US009603405B2

(12) United States Patent
Blecherman et al.

(10) Patent No.: US 9,603,405 B2
(45) Date of Patent: Mar. 28, 2017

(54) HELMET EXTENSION CONNECTED TO SHOULDER PAD TO PREVENT BRAIN AND SPINE INJURIES

(71) Applicants: Joshua A. Blecherman, Wayne, NJ (US); Sol S. Blecherman, Wayne, NJ (US)

(72) Inventors: Joshua A. Blecherman, Wayne, NJ (US); Sol S. Blecherman, Wayne, NJ (US)

( * ) Notice: Subject to any disclaimer, the term of this patent is extended or adjusted under 35 U.S.C. 154(b) by 1 day.

(21) Appl. No.: 14/756,106

(22) Filed: Aug. 3, 2015

(65) Prior Publication Data

US 2017/0035137 A1 Feb. 9, 2017

(51) Int. Cl.
*A42B 3/04* (2006.01)
*A63B 71/12* (2006.01)
*A42B 1/08* (2006.01)

(52) U.S. Cl.
CPC ..... *A42B 3/0473* (2013.01); *A42B 1/08* (2013.01); *A63B 71/12* (2013.01)

(58) Field of Classification Search
CPC ..... A42B 3/0473; A42B 1/08; A63B 71/12
See application file for complete search history.

(56) References Cited

U.S. PATENT DOCUMENTS 3,873,996 A * 4/1975 Varteressian ..... A42B 3/0473 2/421
3,900,896 A * 8/1975 Ackerman ..... A63B 71/1291 2/425
5,261,125 A * 11/1993 Cartwright ..... A42B 3/0473 2/421
5,371,905 A * 12/1994 Keim ..... A42B 3/0473 2/413
5,437,613 A * 8/1995 Reggio ..... A42B 3/0473 2/425
5,715,541 A * 2/1998 Landau ..... A41D 13/05 2/410
6,385,781 B1 * 5/2002 Rose ..... A42B 3/00 2/421
6,619,751 B1 * 9/2003 Shah ..... A42B 3/0473 2/410
6,874,170 B1 * 4/2005 Aaron ..... A41D 13/0512 2/421
7,430,767 B2 * 10/2008 Nagely ..... A42B 3/0473 2/425

(Continued)

*Primary Examiner* — Shaun R Hurley
*Assistant Examiner* — Andrew W Sutton

(57) ABSTRACT

A helmet features a fixed length vertical extension, originating at the rear-bottom-center of the helmet, with height adjustable features at the bottom of the extension, connected to a fixed bracket, at the rear-top-center of current state-of-the-art shoulder pads or shoulder harness. The fixed In-place helmet is located above the head, without contact, and permits the wearer to move his head in all directions. A shock absorbing cap is worn and fills a portion of the space between the top of the head cap and the inside of the helmet, leaving sufficient room for head motion. There are no moving parts in the assembled system. The vertical helmet extension when attached to the shoulder pad bracket will resist elongation or compression along the vertical axis when impacted, but undergo flexure displacement in any lateral direction, followed by shape recovery after impact.

5 Claims, 5 Drawing Sheets

(56) References Cited

U.S. PATENT DOCUMENTS

| | | | | |
|---|---|---|---|---|
| 8,341,770 | B2 * | 1/2013 | Siegler | A42B 3/0473 2/410 |
| 8,621,672 | B2 * | 1/2014 | Chuback | A41D 13/0512 2/421 |
| 8,834,394 | B2 * | 9/2014 | Ghajar | A61F 5/055 128/846 |
| 2002/0100109 | A1 * | 8/2002 | Hoop | A41D 13/0512 2/425 |
| 2006/0096010 | A1 * | 5/2006 | Glaser | A42B 3/0473 2/411 |
| 2008/0209617 | A1 * | 9/2008 | Castillo | A42B 3/0473 2/461 |
| 2008/0313791 | A1 * | 12/2008 | Nagely | A42B 3/0473 2/425 |
| 2010/0083424 | A1 * | 4/2010 | Linares | A42B 3/12 2/413 |
| 2011/0035865 | A1 | 2/2011 | Olivares | |
| 2011/0277225 | A1 | 11/2011 | Salkind et al. | |
| 2014/0109304 | A1 | 4/2014 | Kwan | |
| 2014/0283287 | A1 * | 9/2014 | Pocatko | A42B 3/0473 2/421 |
| 2014/0323921 | A1 * | 10/2014 | Huang | A61B 5/4064 600/587 |
| 2015/0080768 | A1 * | 3/2015 | Huang | A42B 3/0473 600/595 |
| 2015/0223542 | A1 * | 8/2015 | Fischell | A42B 3/0473 2/461 |
| 2016/0037850 | A1 * | 2/2016 | Benson | A42B 3/0473 2/411 |
| 2016/0157543 | A1 * | 6/2016 | Huang | A42B 3/0473 2/411 |

* cited by examiner

HELMET EXTENSION CONNECTED TO SHOULDER PAD TO PREVENT BRAIN AND SPINE INJURIES

FIELD OF INVENTION AND PARTIES INVOLVED

The idea for this patent began to evolve in January, 2011 during family discussions. Our focus was to find a way to reduce football players' head and neck injuries. Other sports and activities were also considered as possible recipients of our families approach. During the early months of 2015 a new approach was presented by my grandson Joshua A. Blecherman, leading to the current embodiment. There were no previous submittals.

BACKGROUND

The one piece fixed-in-position helmet and extension can be manufactured by injection molding or formed separately by compression or thermoplastic molding and then mechanically attached to the helmet. The rectangular cross section ribbon-shaped extension may also be fabricated from a metal alloy, or a metal or plastic composite alloy.

This semi rigid extension is designed to transfer impact force from any direction into a shoulder pad bracket and then to the player through the pads. The extension will bend to a degree within the elastic property range of the material and section modulus, and recover to its original shape. Impact forces to the head and neck will be absorbed and attenuated by the fixed helmet not contacting the head, the helmet liner, and the helmet extension simultaneously and then transferred through the helmet extension into the shoulder harness bracket and finally fully attenuated through the body of the player. This absorption and redistribution of force will reduce head and neck movement thereby decreasing the potential for whiplash of the brain within the skull and also reduce the effect of blunt force trauma to the head. Rotational head movement within the fixed helmet will not be restricted and the open helmet design will permit visibility in all directions. In addition, the head will not be burdened with the additional weight of the helmet thereby decreasing the inertial momentum force upon the head and neck during impact.

The high incidence of head and neck injuries in football continues to exact a high price on the health and well-being of high school, college and professional players. Similar head and neck injuries are noteworthy in other sports, such as skiing. In the prior art (FIG. 1) the player wears a heavy padded helmet. Although the helmet is well padded, high levels of impact to the head continue to result in blunt force trauma, whiplash and high levels of neck strain at all age levels of football participation. These injuries also have had long term effects on aging football players.

The proposed embodiment can significantly reduce these injuries by means of an improved helmet and helmet extension design and energy absorption system that will reduce head and neck trauma without restricting player visibility or head position. This embodiment incorporates an extension at the rear center of the helmet which is coupled to a shoulder harness or existing football type shoulder pads. There are four principle components to the design: The fixed-in-place helmet and extension which does not contact the head; the shock absorbing cap worn by the player; the shoulder pads or shoulder harness; and the connecting bracket mechanically attached to the rear top of the shoulder pads. The embodiment will provide an energy absorption/redistribution-shape-recoverable system which limits head deflection upon impact. The helmet extension is designed to reduce head deflection and absorb impact energy from all directions of force. The embodiment will significantly reduce the whiplash effect of the brain within the skull, reduce blunt force trauma, and also prevent neck injury.

Production-ready materials are available to implement this embodiment. Processional football helmet exteriors are most often fabricated of tough high impact resistant polycarbonate plastic (tensile strength=6,000 psi; modulus=300,000 psi); youth football and safety helmets are constructed of acrylonitrile butadiene styrene (ABS). These materials have good impact and strength properties and can survive repeated blows without damage. The crown area of some football helmets are constructed of vinyl nitrile. A copolymer colyene (85% polypropylene/15% polyethylene); (tensile strength=4,000 psi; modulus=195,000 psi) is used to fabricate leg braces and prosthetics. All these materials are readily available, easily formable and have good impact resistance, tensile/flexure strength, and modulus properties over a wide range. These materials can be analytically screened for effective performance using three dimensional finite element analysis for the embodiment described and the best candidates would be further evaluated in laboratory prototype impact testing.

SUMMARY

The proposed embodiment of the design, to prevent brain and neck injuries to the wearer, will include a modified football type helmet, not contacting the wearer's head. This design will provide unlimited visibility when the head is turned inside the fixed position helmet in any direction. The player's head, wearing a shock absorbing cap, will be free to move in all directions. The helmet will feature a semi-rigid straight member extending from the rear bottom center of the helmet. This extension will be connected to a bracket at the rear top center of a shoulder pad or shoulder harness. Unlike current helmet designs the helmet does not contact the head at any point. The helmet extension will be fixed in place by a bracket mechanically attached to the top rear center of the shoulder pad so that all of the helmet and extension weight are borne by the shoulder pads. The bottom of the helmet extension will have several horizontal helmet height adjustment slots. The helmet and extension will be fixed in place with an easily insertable and removable locking pin.

Force to the helmet, during impact, will be distributed into the shock absorbing cap and into the semi-rigid, load-compliant, extension at the back of the helmet and then into the body of the wearer through the shoulder pads. The rigidity of the helmet and extension and load sharing/distribution of force into the shoulder pads will significantly reduce head deflection and increase energy absorption during impact. This in turn will reduce whiplash and blunt force trauma and limit neck extension.

The helmet extension will be shaped and designed specifically to provide for variations in limited flexure (side-to-side, or fore-to-aft bending) upon impact, and full recovery of shape after impact, very much like a spring. The helmet extension design will be rigid and unyielding to tensile or compressive forces. Any number of helmet extension materials may be candidates where their mechanical properties have been validated in varied sports and prosthetic applications.

Three dimensional finite element analysis followed by laboratory prototype impact testing of material candidates with varying helmet extension width-to-thickness ratios would identify the ideal helmet extension design for the range of player size, from little league to professional football, and for different sports.

DETAILED DESCRIPTION

Figure 1:
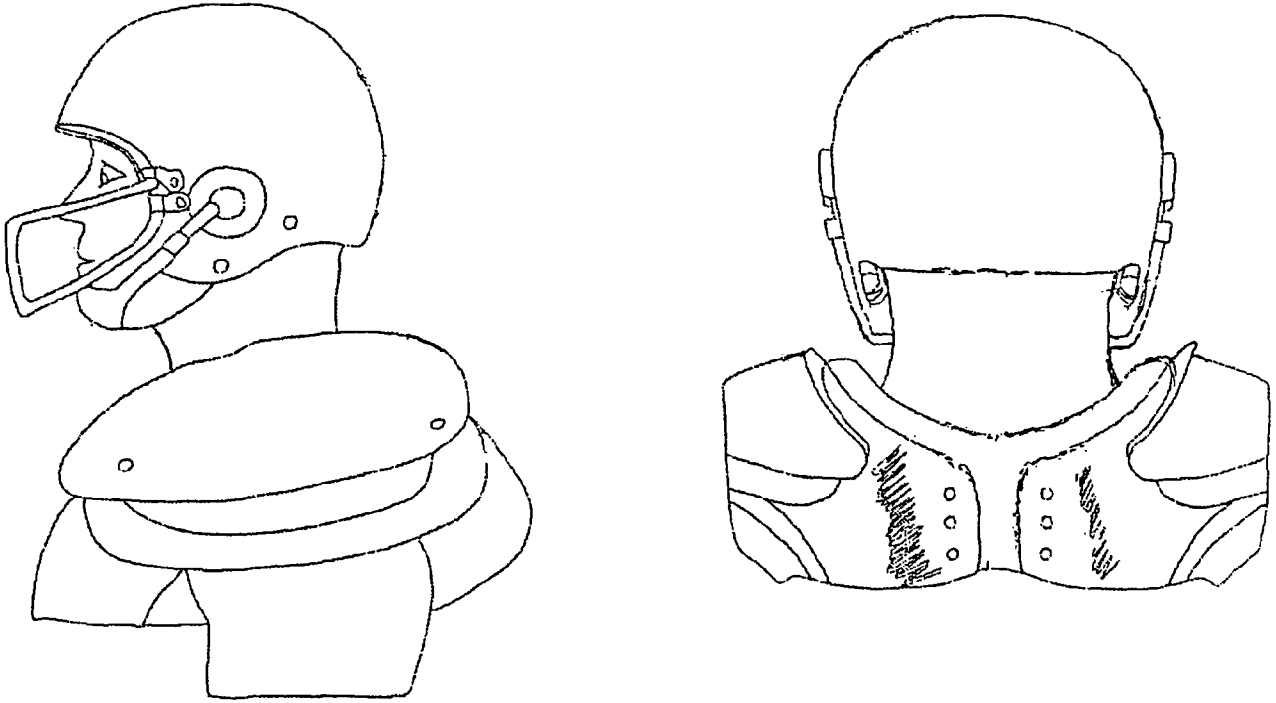
FIG.1 (PRIOR ART)
FIG. 1 is the side and rear views of the prior art helmet configuration.

FIG. 1 shows the side and rear views of the prior helmet design. Most helmets are manufactured by injection or compression molding polycarbonate and other plastics which have good impact resistance and high tensile and modulus properties.

Figures 2, 3:
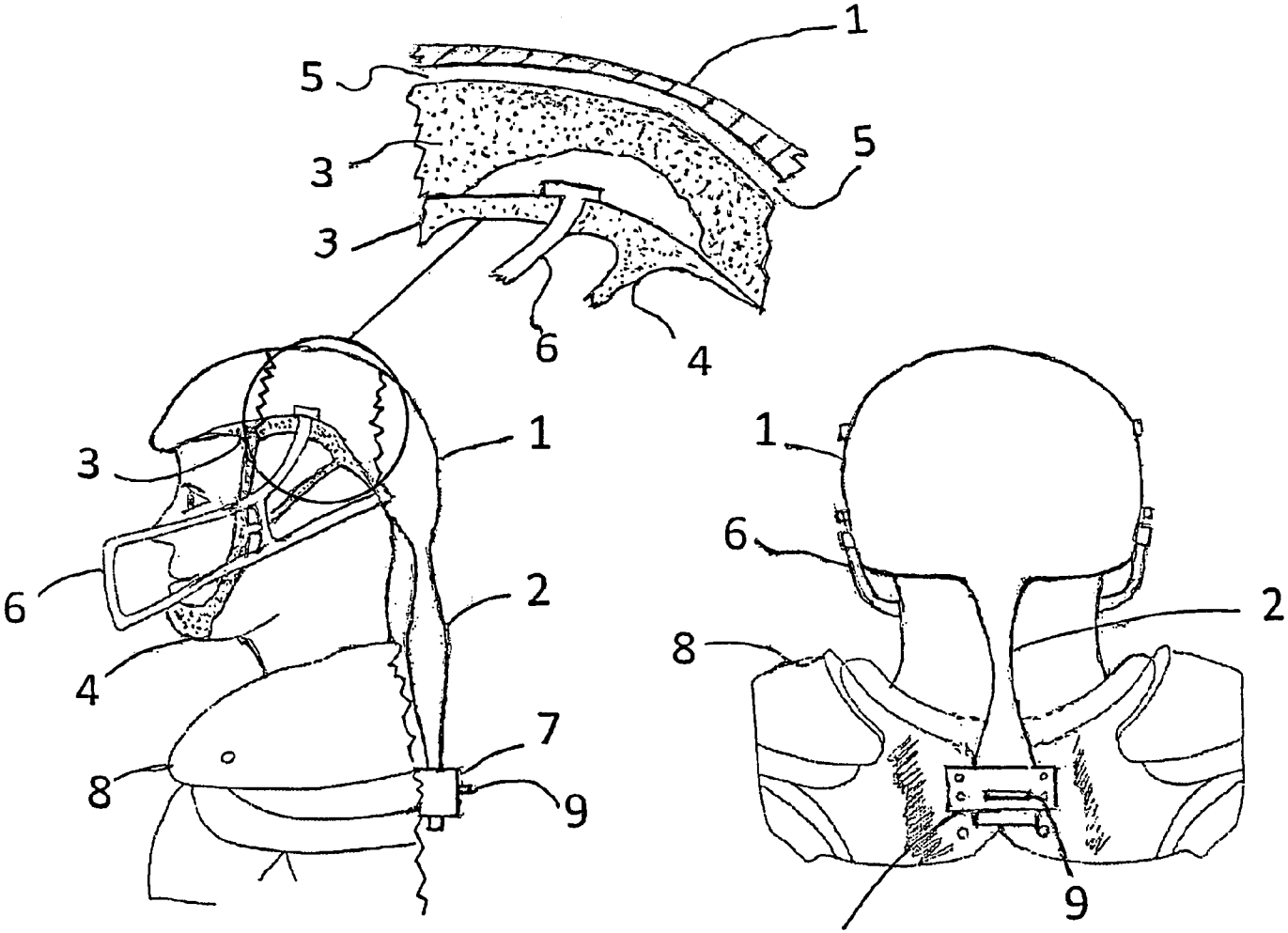
FIGS. 2 and 3 are the side and rear views of the proposed increased visibility, modified football helmet, shock absorbing cap and helmet rear center extension into the shoulder pad bracket.

FIGS. 2 and 3 show the side and rear views of the open area helmet 1 and the helmet rear extension 2, a shock absorbing head cap 3, the cap retaining straps and chin strap 4, a very small space between the wearer's cap and the inside surface of the helmet 5, and one form of traditional face mask protection 6. The helmet extension is of sufficient length to engage a bracket 7 which is mechanically attached to the rear top center of the shoulder pads 8. The locking pin 9 will secure the helmet extension in the bracket and fix the appropriate helmet height for the wearer. Impact force to the head or neck will be transmitted to the shock absorbing cap 3 and into the helmet extension 2 simultaneously and then into the shoulder pads 8. The helmet front and side areas have been opened up to allow full visibility, as the head is turned, in any direction. The wearers' shock absorbing cap 3, in the gap between the fixed-in-position helmet and the skull, can utilize any of the currently available materials. These shock absorbing and energy transferring materials include solids such as elastomers or more firm urethanes, or liquid or gas filled containers. These materials can be employed separately or integrated into different sections of the helmet liner cap. The fitted cap, with a low coefficient of friction top surface, allows the head to turn without restriction and is held in place by straps connected to a chin pad 4. The helmet 1 is fixed and does not move as the wearer turns his head. The helmet extension 2 originates at the rear bottom center of the helmet and, if a polymer, may be injection, compression or transfer molded as one part. The extension may also be made of other materials such as metal alloys, composite metal alloys or polymer composite alloys and mechanically attached to the bottom of the helmet.

The helmet extension design, FIGS. 2 and 3, show the rectangular shaped ribbon viewed from the side of the helmet 10 and from the rear 11, respectively. The helmet extension ribbon 2 undergoes a 180 degree smooth continuous turn from its origin at the bottom of the helmet to its termination site, the bracket at the rear top center of the shoulder pad 7. There are multiple advantages for this design. Regardless of the direction of impact to the helmet, the helmet extension ribbon feature will have a region along the ribbon where the maximum section modulus (resistance to bending) faces the direction of impact. In addition, the impact point on a curved surface helmet will, in almost all instances, change as the impacting body's force follows through. Therefore, new force points are continually engaging new adjacent section moduli locations on the helmet extension ribbon. This sequential multiple section modulus engagement results in attenuating the initial impact force through the extension 2 and into the bracket 7 on the shoulder pads. An additional geometric variable in the ribbon which can provide a benefit to this design are centerline circular holes 12 in the ribbon. The holes, if incorporated, will reduce the local flexure section modulus thereby permitting the wearer to tilt his head to the left or right (wearers can always rotate their heads) while not significantly detracting from the force attenuation benefits derived from the ribbon design. The number and size of holes, are another variable that require evaluation in a three dimensional analytical finite element evaluation and proof of concept in a laboratory prototype helmet extension program. The maximum diameter of any hole should not be greater than 50% of the width of the extension ribbon; holes may be smaller. The frequency of holes will also be determined by analysis and testing and will vary depending on the needs of the wearers' size.

Figure 5:
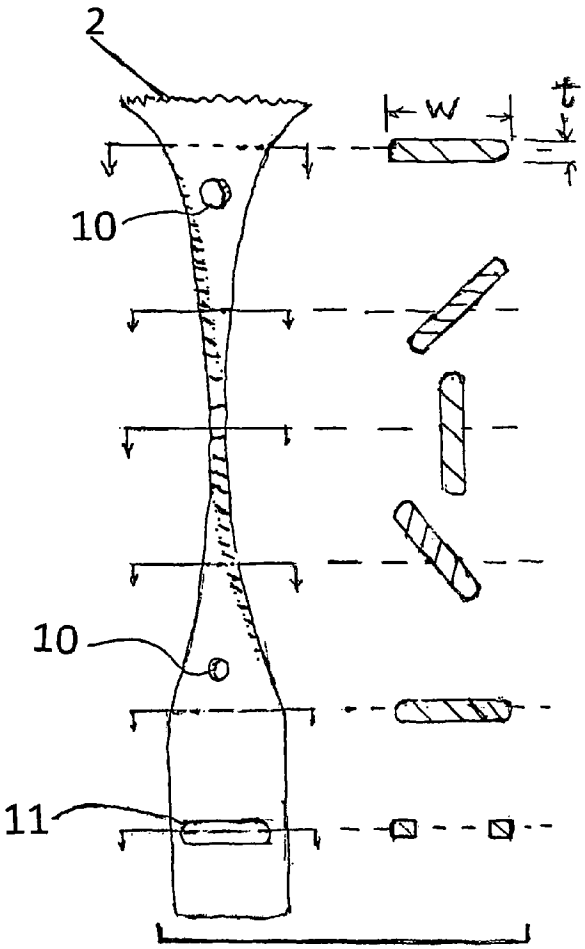
FIGS. 4 and 5 show side and rear perspective and cross sectional views of the rectangular ribbon-shaped helmet extension rotated 180 degrees about its longitudinal central axis.
Figure 4:
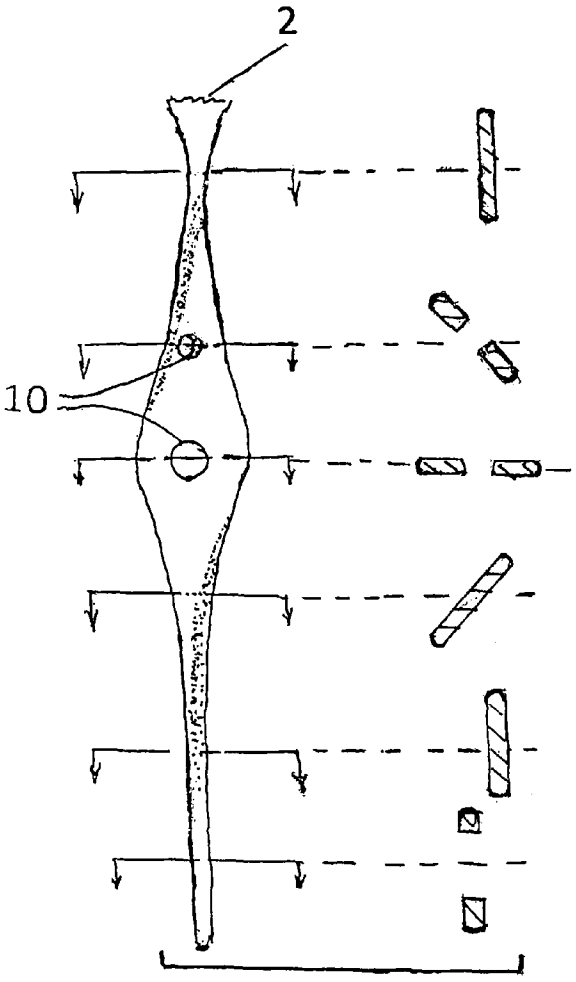

Testing of prototype extension designs in the laboratory, of varying width-to-thickness ratio ribbons, will define the degree of flexure and recovery for different intensity levels and impact directions. The desirable result will be to obtain proportionally increased helmet extension (ribbon) deflection at increased loads and then full recovery of helmet extension shape and dimension. In mechanical engineering terms this means that maximum deflection of the helmet extension, from expected maximum forces on the assembled design, will not exceed the flexure strength, or the flexure or section modulus of the material with appropriate safety factors considered. Polymer candidate materials were defined earlier. In addition to material properties influencing the design there are any number of rectangular ribbon width (w)-to-thickness (t) ratios that could satisfy the design. Although the rectangular ribbon shape is illustrated in this embodiment, it is also expected that modulus and flexure strength requirements can also be met as the rectangular ribbon dimensions approach a square (w=t) or rod configuration. Also shown in FIGS. 4 and 5, at the bottom of the helmet extension, is one of several typical engagement slots 13 that permit the extension to be retained by the shoulder pad bracket for helmet height adjustment.

Figure 6:
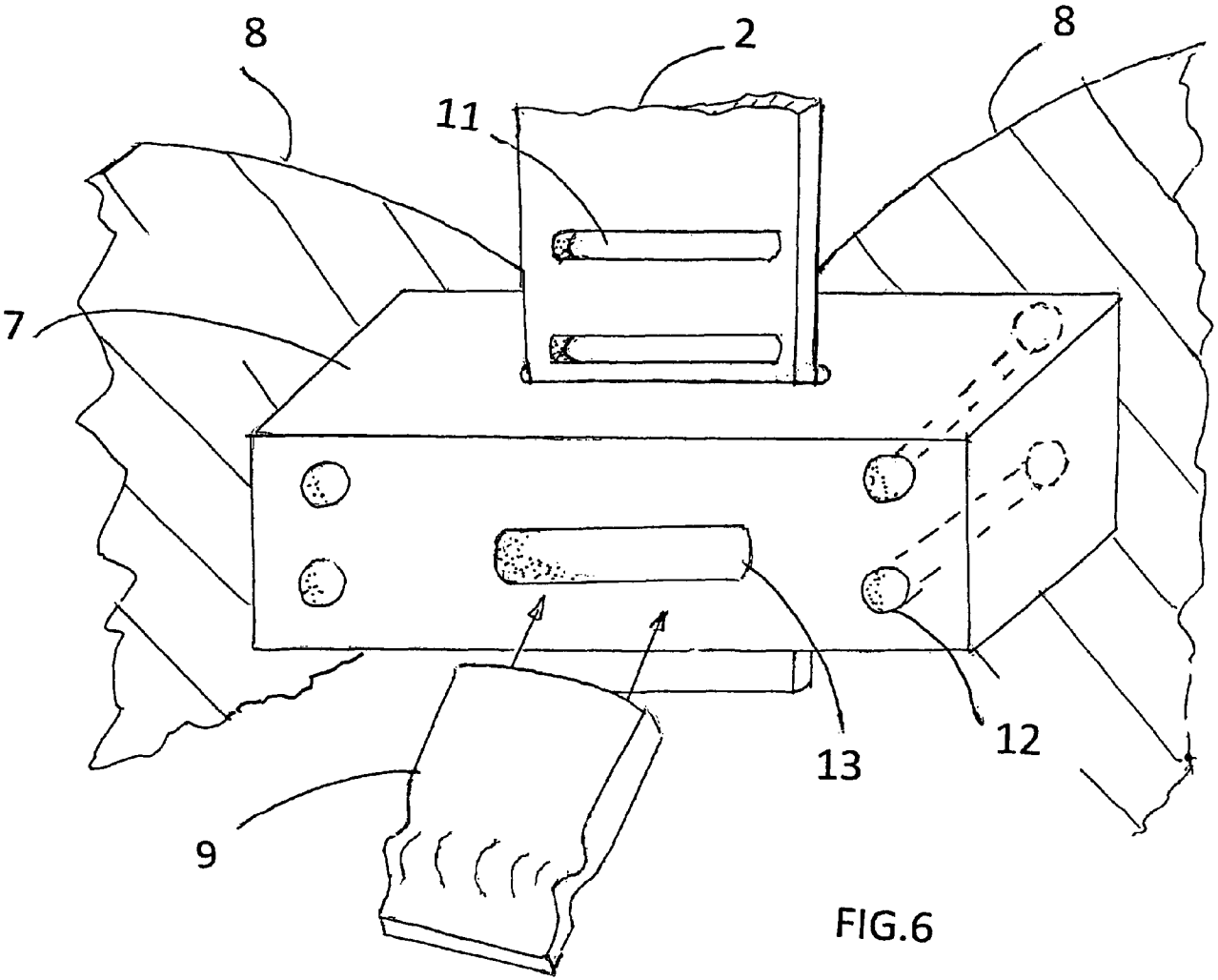
FIG. 6 is the shoulder pad attachment bracket showing the locking-pin prior to loading.

FIG. 6 shows the rear view of the helmet extension 2 fitted into the bracket 7 at the rear top center of the shoulder pads 8. The bracket is attached to the shoulder pads by conventional mechanical means such as bolts or rivets; typical bolt holes and location for attachment are shown 12. Also shown is the bracket pin 9, in the loading position, prior to entering the bracket.

Figure 7:
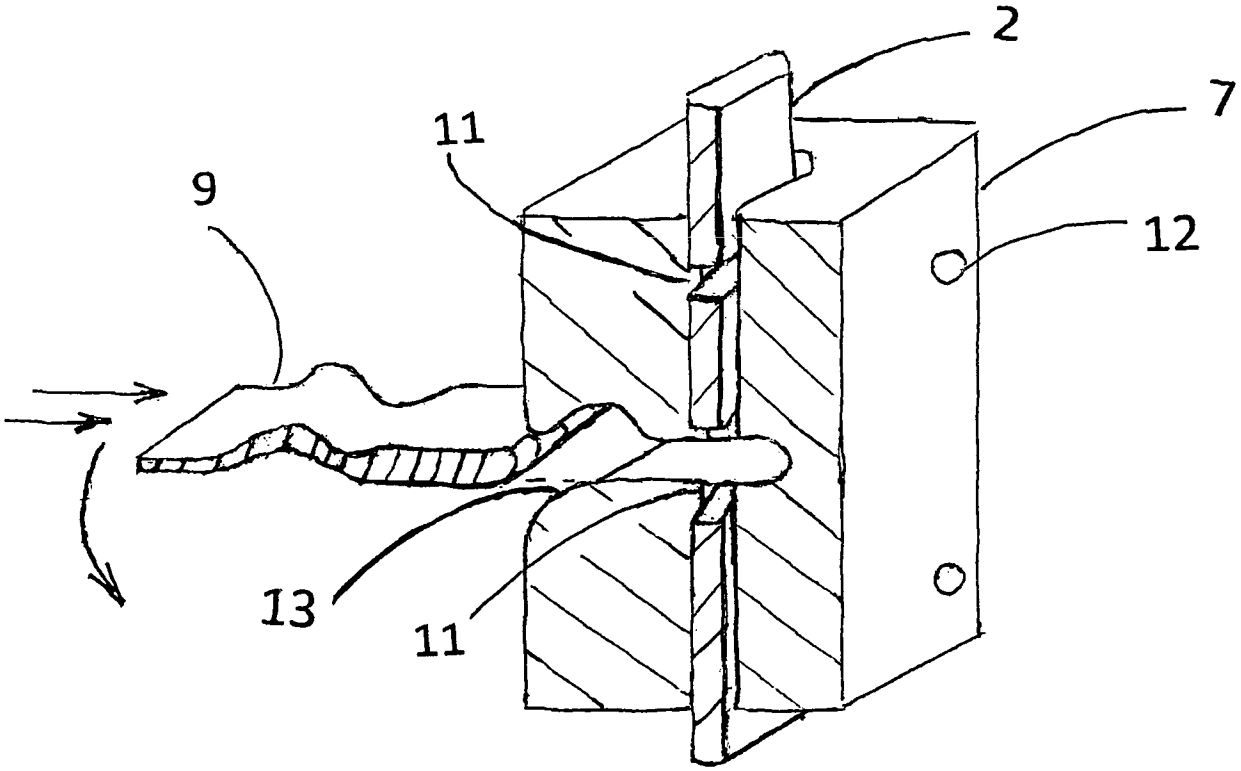
FIG. 7 shows the mid-plane section of the shoulder pad bracket with pin quick-lock-and-release features.

FIG. 7 shows the centerline section of the bracket 7 with a more detailed illustration of the rectangular pin 9 with snap-in lock features and bracket-slot contours 13 facilitating easy engagement and rapid removal. Also shown are height adjustable slots 11 in the bottom section of the helmet extension.

The invention claimed is:

1. A head and neck shock absorbing and deflection attenuation system, comprised of a fixed-position helmet, with a rectangular cross-section helmet extension, from the helmet rear-center bottom, that is rotated 180 degrees about its central longitudinal axis, parallel to the spine, a shock absorbing cap configured to be worn by the player, under, but not contacting the helmet, and shoulder pads or harness with attached bracket which secures the bottom of the helmet extension.

2. A head and neck shock absorbing and deflection attenuation system, comprised of a fixed-position helmet, configured to be above the head and not contact the wearer, with a rectangular cross-section helmet extension, from the helmet rear-center bottom, that is rotated 180 degrees about its central longitudinal axis, parallel to the spine, a shock absorbing cap configured to be worn by the player, under, but not contacting the helmet, an open sided helmet with face guard protection for maximum side-to-side visibility, and shoulder pads or harness with attached fixed-in-place bracket which secures the bottom of the height-adjustable helmet extension.

3. A head and neck shock absorbing and deflection attenuation system, comprised of a fixed-position helmet, configured to be above the head and not contact the wearer, with a rectangular cross-section helmet extension, from the helmet rear-center bottom, that is rotated 180 degrees about its central longitudinal axis, parallel to the spine, constructed of a plastic alloy, metal alloy or composite material, allowing lateral displacement upon impact, and shape recovery after impact, a shock absorbing cap configured to be worn by the player, under, but not contacting the helmet, an open-sided helmet with face guard protection for maximum side-to-side visibility, and shoulder pads or harness with attached fixed-in-place bracket which secures the bottom of the height-adjustable helmet extension.

4. A head and neck shock absorbing and deflection attenuation system, comprised of a fixed-position helmet configured to be above the head and not contact the wearer, with a rectangular cross-section helmet extension, from the helmet rear-center bottom, that is rotated 180 degrees about its central longitudinal axis, parallel to the spine, constructed of a plastic alloy, metal alloy or composite material, allowing lateral displacement upon impact, and shape recovery after impact, configured to have decreased flexure bending stiffness in localized areas to permit wearer to tilt head, a shock absorbing cap configured to be worn by the player, under, but not contacting the helmet, an open-sided helmet with face guard protection for maximum side-to-side visibility, and shoulder pads or harness with attached fixed-in-place bracket which secures the bottom of the height-adjustable helmet extension.

5. A head and neck shock absorbing and deflection attenuation system, comprised of a fixed-position helmet, configured to be above the head and not contact the wearer, with a rectangular cross-section helmet extension, from the helmet rear-center bottom, that is rotated 180 degrees about its central longitudinal axis, parallel to the spine, constructed of a plastic alloy, metal alloy or composite material, allowing lateral displacement upon impact, and shape recovery after impact, configured to have decreased flexure bending stiffness in localized areas to permit wearer to tilt head, a shock absorbing cap configured to be worn by the player, under, but not contacting the helmet, an open-sided helmet with state-of-the-art face guard protection for maximum side-to-side visibility, and bracket with adjustable height features attached at the rear center of shoulder pad or shoulder harness to secure the bottom of the height-adjustable helmet extension.

* * * * *